US008448924B2

(12) United States Patent
Keller

(10) Patent No.: US 8,448,924 B2
(45) Date of Patent: May 28, 2013

(54) ALTERNATIVE-FUEL INDUCTOR FOR ENGINES

(76) Inventor: John M. Keller, Summersville, WV (US)

( * ) Notice: Subject to any disclaimer, the term of this patent is extended or adjusted under 35 U.S.C. 154(b) by 264 days.

(21) Appl. No.: 13/032,307

(22) Filed: Feb. 22, 2011

(65) Prior Publication Data

US 2011/0203109 A1 Aug. 25, 2011

Related U.S. Application Data

(60) Provisional application No. 61/306,127, filed on Feb. 19, 2010.

(51) Int. Cl.
*F02M 19/06* (2006.01)

(52) U.S. Cl.
USPC 261/18.3; 29/888.011; 261/76; 261/DIG. 75; 285/910

(58) Field of Classification Search
USPC ..... 261/18.3, 66, 76, 116, DIG. 75; 123/431; 29/888.011; 285/910
See application file for complete search history.

(56) References Cited

U.S. PATENT DOCUMENTS

| | | | | |
|---|---|---|---|---|
| 2,039,354 | A * | 5/1936 | Seidel | 261/18.3 |
| 2,406,913 | A * | 9/1946 | Serrano | 261/145 |
| 3,286,997 | A * | 11/1966 | Ledbetter | 261/18.3 |
| 3,414,242 | A * | 12/1968 | Bouteleux | 261/18.3 |
| 4,415,507 | A * | 11/1983 | Voliva | 261/18.3 |
| 4,518,540 | A * | 5/1985 | Takayasu | 261/18.3 |
| 4,594,201 | A * | 6/1986 | Phillips et al. | 261/18.3 |
| 5,667,730 | A * | 9/1997 | Barfield | 261/18.3 |
| 6,848,681 | B2 * | 2/2005 | Washington et al. | 261/76 |
| 7,398,962 | B2 * | 7/2008 | Cooper | 261/70 |
| 2006/0180121 | A1 * | 8/2006 | Wickman et al. | 123/299 |

FOREIGN PATENT DOCUMENTS

| | | | | |
|---|---|---|---|---|
| JP | 61-58962 | A * | 3/1986 | 261/18.3 |

* cited by examiner

*Primary Examiner* — Richard L Chiesa

(74) *Attorney, Agent, or Firm* — Gardner Groff Greenwald & Villanueva, PC

(57) ABSTRACT

A secondary-fuel inductor for an engine including a carburetor with a primary fuel inlet having an outlet end. The inductor includes a gasket and a fuel conduit. The gasket defines an opening through which the fuel conduit extends. The fuel conduit has a bend defining a first segment and a second segment. The first segment includes a gasket-spanning segment that extends through the fuel-conduit opening and an inlet end that can have a connector for connection to a fuel line for a secondary fuel. And the second segment includes an outlet end positioned within a venturi area of the carburetor, for example, immediately adjacent the outlet end of the primary fuel inlet.

19 Claims, 7 Drawing Sheets

ALTERNATIVE-FUEL INDUCTOR FOR ENGINES

CROSS-REFERENCE TO RELATED APPLICATION

This application claims the priority benefit of U.S. Provisional Patent Application Ser. No. 61/306,127, filed Feb. 19, 2010, which is hereby incorporated herein by reference.

TECHNICAL FIELD

The present invention relates generally to fuel systems for internal combustion engines and, in particular, devices for adapting engines to efficiently run on alternative fuels.

BACKGROUND

Engines that are designed to burn one type of fuel are sometimes converted to burn an alternative type of fuel. For example, gasoline-fueled engines in forklifts, generators, etc. are oftentimes converted to burn propane and/or natural gas (commonly referred to as alternative fuels). Advantages of this conversion reduced exhaust emissions from and lower operating costs of burning the alternative fuels, and longer run times between refueling due to larger fuel tanks or connecting to utility gas pipe systems.

The conventional methods for converting conventional engines to burn a different fuel than they were designed for have proven problematic. For example, many conventional gasoline engines include a carburetor made of an aluminum block forming a venturi area, with a fuel inlet passageway extending through the block into the venturi area, and with a copper fuel inlet tube extending through the passageway. The venturi area creates a reduced pressure to draw the gasoline through the fuel inlet tube and into the venturi area of the carburetor. When converting such a gasoline engine to burn an alternative fuel, the gasoline fuel inlet tube is too small in diameter to deliver a sufficient volume of alternative fuel into the carburetor, so it generally cannot be used. So in one common conversion method, the gasoline inlet tube is removed, the gasoline inlet passageway in the carburetor block is drilled larger, and a correspondingly larger alternative-fuel inlet tube inserted into it. But this is a permanent modification to the carburetor, so it can never be practically used for gasoline again—it's an irreversible conversion process.

The other common conversion method includes inserting an adapter into the air stream ahead of the carburetor to introduce the alternative fuel to the carburetor. FIG. 1 shows one such prior-art alternative-fuel adapter 10 mounted between the air-inlet side of the carburetor 12 and the air filter 14 (i.e., the air cleaner assembly) of a gasoline engine 16. Inlet and outlet gaskets 18 and 20 are provided at the inlet and outlet sides of the adapter 10. The adapter 10 includes an appropriately-sized alternative fuel inlet 22 and a venturi 24 to draw the fuel 28 into the carburetor 12 for mixing with air 26. A common problem with using these adapters 10 is that, because of their thickness (commonly about 1¼ inches), they add overall size to the engine 16. So oftentimes the air filter 14 will not fit back on and one of the machine's structural vertical frame supports (not shown; typically positioned less than 1" from the air filter assembly) must be cut to allow the needed additional clearance/space. In addition, because the air filter 14 is repositioned farther away, the air-inlet hose (not shown) oftentimes has to be lengthened or replaced. Furthermore, additional labor and cost is required to replace or modify the studs that hold the carburetor to the engine, for example, by replacing the existing studs with longer ones or by adding "stud extenders" to make up for the 1¼" additional length. Moreover, an important issue for multi-fueled engines is the delivery of the alternative fuel 28 to the air stream 26 in such a way/position as to utilize the negative pressure signal necessary for zero governor regulators to function. Because the prior art adapters 10 introduce the alternative fuel 28 to the carburetor 12 at a position that is different from what the carburetor was designed for, the engines 16 typically do not run as well or efficiently as they were designed to.

Accordingly, it can be seen that there exists a need for a better way to introduce alternative fuels for combustion in engines. It is to the provision of solutions to this and other problems that the present invention is primarily directed.

The specific techniques and structures employed to improve over the drawbacks of the prior devices and methods and accomplish the advantages described herein will become apparent from the following detailed description of example embodiments and the appended drawings and claims.

SUMMARY

The present invention relates generally to inductors for converting an internal combustion engine from burning a primary fuel to burning a secondary fuel. Such engines include a carburetor with a venturi area and a primary fuel inlet having an outlet end within the venturi area. The inductor includes a gasket and a fuel conduit. The gasket defines an axial airflow opening and a transverse fuel-conduit opening through which the fuel conduit extends, and is adapted to form a seal with the carburetor when mounted in place. The fuel conduit has an outlet end and extends transversely through the fuel-conduit opening and into the axial airflow opening. When the inductor is mounted to the carburetor, the outlet end of the fuel conduit is positioned in the venturi area of the carburetor.

In a typical commercial embodiment, the fuel conduit has a bend defining a first segment and a second segment. The first segment includes a gasket-spanning segment that extends through the fuel-conduit opening, and an inlet end with a connector for connection to an alternative fuel line. The second segment extends axially within the carburetor and includes an outlet end positioned immediately adjacent the outlet end of the primary fuel inlet. The bend in the fuel conduit is at 90 degrees, the first segment of the fuel conduit has a portion inside the carburetor with a length that is substantially the same as the length of the primary fuel inlet inside the carburetor, and the second segment of the fuel conduit is generally parallel to an airflow axis of the carburetor and has a length so that the outlet end is positioned immediately adjacent the primary fuel inlet.

In some embodiments, the fuel conduit outlet end is angled. For example, the fuel conduit outlet end can be angled at 45 degrees and have a pointed tip. In some embodiments, the fuel-conduit opening extends axially all the way through the gasket, and the gasket and the gasket-spanning segment of the fuel conduit have substantially the same thickness so that they are axially flush with each other to cooperate in forming a good seal against the carburetor. In some other embodiments, the fuel-conduit opening extends axially only partially through the gasket, and the gasket has at least one side panel adjacent the fuel-conduit opening. In some embodiments, the fuel-conduit opening and the fuel conduit first segment extend at least a portion of the way around the periphery of the gasket, and the fuel conduit second segment is provided by a plurality of second segments extending from the first segment. For example, the fuel conduit first segment can extend all the way around the periphery of the gasket and have four or another number of second segments extending transversely from it.

In another aspect, the invention relates to a method of converting an engine from burning a primary fuel to burning an alternative fuel. The method includes exposing an air inlet side of a carburetor of the engine. This is typically done by removing the air filter. Then an inductor of the type described herein is mounted to the air inlet side of the carburetor, and the air filter is replaced with the inductor positioned between the carburetor and the air filter. Then the inlet end of the fuel conduit of the inductor is connected to an alternative fuel supply. Control valves can be installed in the primary and alternative fuel lines, if desired. The engine is now ready to run on the alternative fuel.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are explanatory of example embodiments of the invention, and are not restrictive of the invention, as claimed.

DETAILED DESCRIPTION OF EXAMPLE EMBODIMENTS

The present invention relates to inductors for converting an internal combustion engine from burning a primary fuel to burning a secondary fuel. In typical commercial embodiments, the inductors can be used for converting an engine from burning gasoline (the primary fuel) to burning propane and/or natural gas (the secondary fuel). In other embodiments, the inductors are adapted for burning as the secondary fuel biodiesel, bioalcohol, vegetable oil, and/or another environmentally friendly alternative fuel. And in yet other embodiments, the inductors are adapted for burning gasoline as the secondary fuel (in cases where the primary fuel is other than gasoline). As used herein, the terms "secondary fuel" and "alternative fuel" are used interchangeably, and as such an alternative fuel is not just biodiesel, bioalcohol, etc. In any event, in various embodiments the inductors can be used with engines to allow them to burn, in addition to the primary fuel, two or more types of alternative fuels interchangeably or only one type of alternative fuel. In addition, while the inductors described herein are designed for use with engines having carburetors, persons of ordinary skill in the art will understand that they can be modified for use with engines instead having fuel injection systems. As such, references to the term "carburetor" herein are intended to include a manifold in an engine with a fuel injection system.

Figure 1:
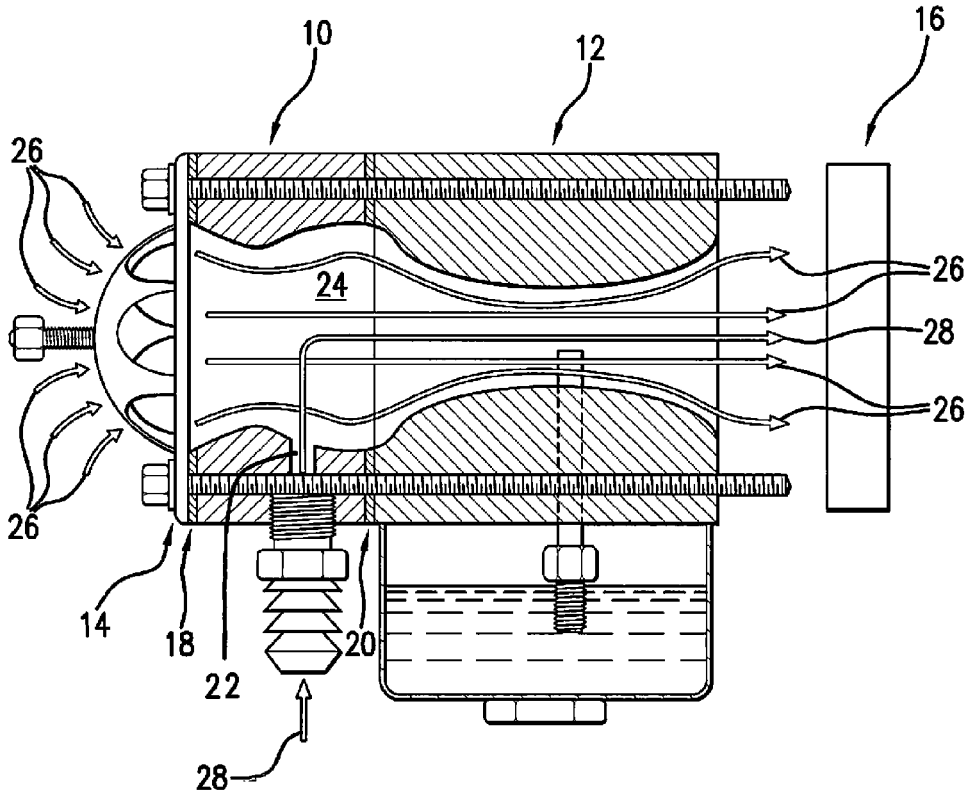
FIG. 1 PRIOR ART
FIG. 1 shows a prior-art alternative-fuel adapter mounted between an air filter and a carburetor of an engine, with the air filter shown in side view, the adapter, carburetor, and gaskets shown in a side cross-sectional view, and the rest of the engine shown schematically.
Figure 2:
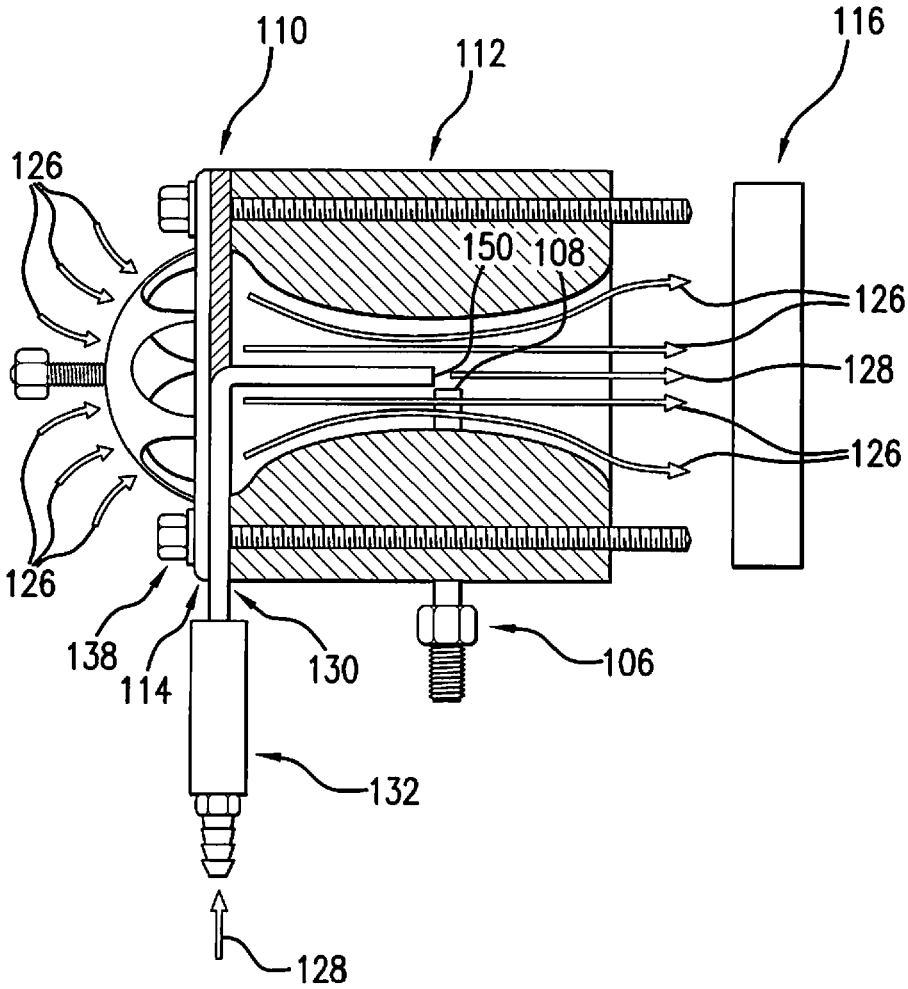
FIG. 2 shows an alternative-fuel inductor according to a first example embodiment of the present invention, with the inductor mounted between an air filter and a carburetor of an engine, with the inductor and the air filter shown in side view, the carburetor shown in a side cross-sectional view, and the rest of the engine shown schematically.
Figure 3:
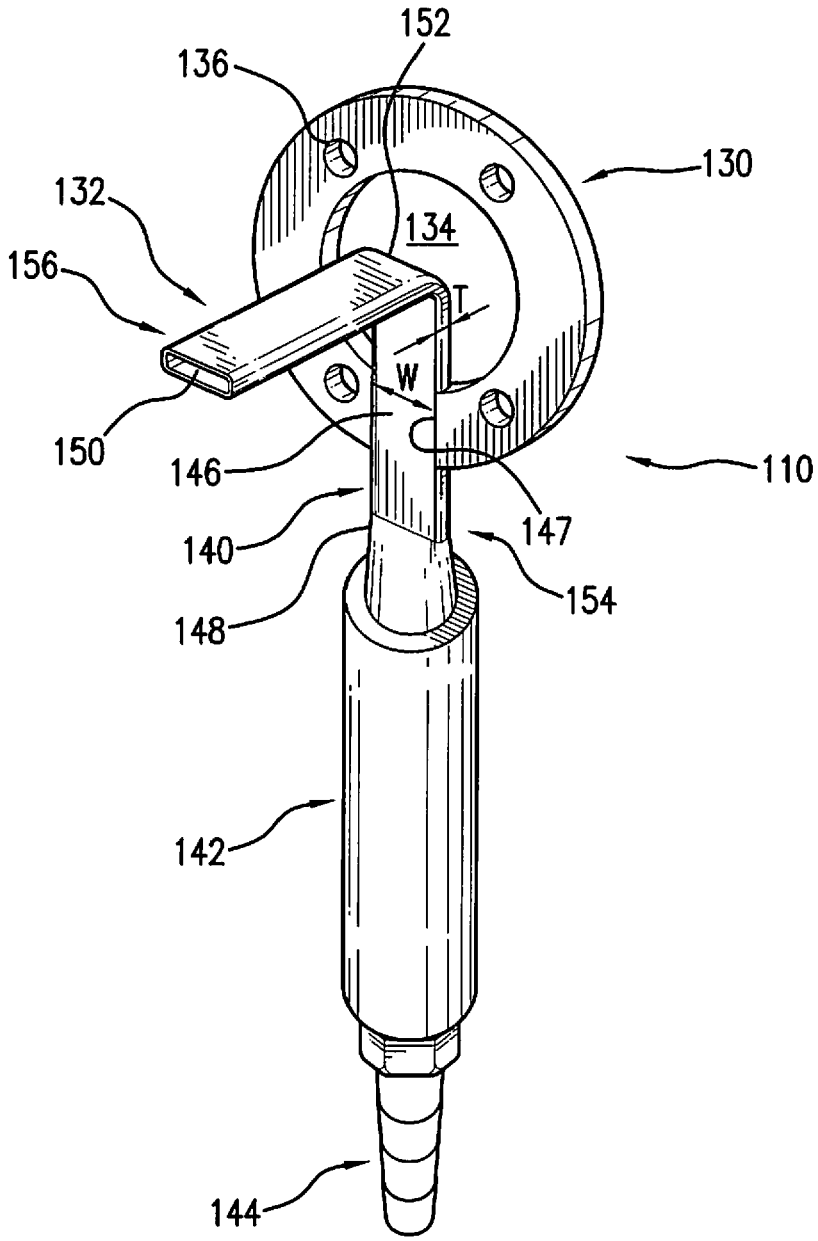
FIG. 3 is a perspective view of the inductor of FIG. 2.
Figure 4:
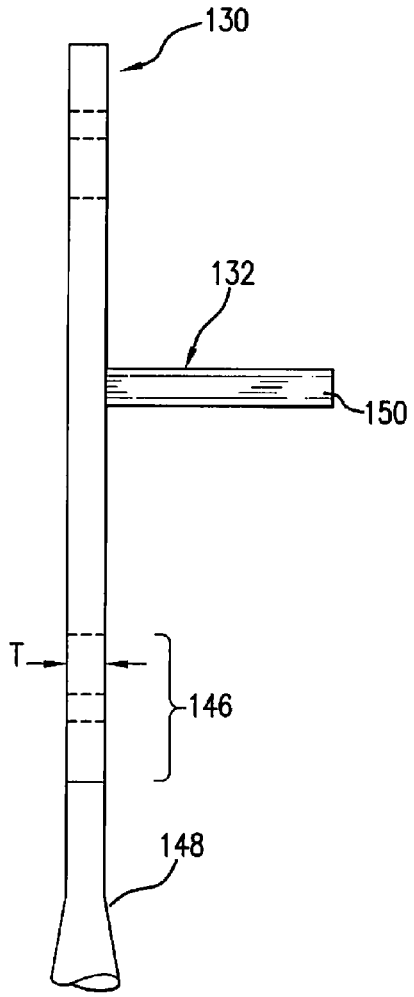
FIG. 4 is a side view of a portion of the inductor of FIG. 2.

FIGS. 2-4 show an alternative-fuel inductor 110 according to a first example embodiment of the invention. The inductor 100 mounts between the air inlet side of a carburetor 112 and an air filter 114 of an engine 116. The inductor 110 includes a gasket 130 and a fuel conduit 132. The gasket 130 forms a seal between the carburetor 112 and the air filter 114, so additional gaskets are not needed, though they can be used (on either or both sides of the inductor) if desired. The gasket 130 is thick enough that the fuel conduit 132 extends through it to deliver the fuel 128 to the carburetor 112 for mixing with the air 126, so a conventional alternative-fuel adapter is not needed.

The gasket 130 is annular and defines an axial air opening 134 that is sized and shaped to conform to the inlet air opening of the carburetor 112 and the outlet air opening of the air filter 114. Typically, the gasket air opening 134 is generally circular, as depicted, though it can have other regular or irregular shapes to fit the carburetor 112 and the air filter 114. In embodiments in which the gasket air opening 134 is circular, it has a diameter that conforms to that of the inlet air opening of the carburetor 112 and the outlet air opening of the air filter 114. The gasket 130 also has mounting holes 136 that receive the mounting bolts 138 used to mount the air filter 114 onto the carburetor 112. Thus, the mounting holes 136 are positioned to align with the mounting holes in the air filter 114 and the carburetor 112. The gasket 130 can be made of a rubber material, a thermoplastic elastomer, cork, paper, or another gasket material suitable for forming a good seal between the carburetor 112 and the air filter 114. In typical commercial embodiments, the gasket 130 is made of a rubber material and has a thickness of about ¼ inch, though it can be made of other materials and formed thinner or thicker if desired in given applications. The gasket 130 can be provided by a plurality of conventional thin (e.g., about 1/32-inch thick) gaskets of the type typically used between the carburetor 112 and the air filter 114, with these conventional gaskets stacked to provide the desired thickness, or by a one-piece unitary gasket specially made with the desired thickness.

The fuel conduit 132 extends transversely through the gasket 130 to deliver the fuel 128 to the carburetor 112. The fuel conduit 132 can be provided by a length of tubing made of brass, stainless steel, plastic, or another material. In the depicted embodiment, the fuel conduit 132 includes a rigid segment 140 made of a rigid tubing (e.g., brass tubing with a thin rubber coating) and a flexible segment 142 made of a flexible tubing (e.g., rubber hosing). The rigid segment 140 extends radially into the carburetor 112 and the flexible segment 142 allows for flexibility in connecting to the alternative fuel line (not shown). A conventional connector 144 is positioned at the inlet end of the fuel conduit 132 for coupling to the alternative fuel line from the alternative fuel tank (typically via a regulator for the engine and/or the tank).

The rigid segment 140 of the fuel conduit 132 extends through the gasket 130 in the depicted embodiment. In alternative embodiments, the flexible segment 142 extends through the gasket 130, though a rigid element of some sort may be needed to keep the fuel conduit 132 from collapsing such that the fuel can not pass through it at the needed volume flow rate. Regardless, the fuel conduit 132 typically has a circular cross-section at the inlet end where the connector 144 is, but its segment 146 that extends through the gasket 130 has a generally rectangular cross-section to conform to the shape and thickness of the gasket. Thus, the fuel conduit 132 includes a circular-to-rectangular transition 148 at some point between the connector 144 and the gasket-spanning segment 146. The remainder of the fuel conduit 132 (between the gasket-spanning segment 146 and the outlet end 150) can have a cross-section that is generally rectangular (as depicted), circular, or another regular or irregular shape. As used herein, "generally rectangular," when used to describe the gasket-spanning segment 146 of the fuel conduit 132, means that both of the width sides W of the gasket-spanning segment are substantially flat, while the thickness sides can be substantially flat or somewhat curved as may be desired for example for ease of manufacture. In the depicted embodiment in which the gasket 130 has an axial gap though its thickness and the gasket-spanning segment 146 of the fuel conduit 132 fills that gap and acts as a seal, the width sides W of the gasket-spanning segment are sufficiently flat that the gasket-spanning segment performs its sealing function.

The gasket-spanning segment 146 of the fuel conduit 132 has a thickness T that is about the same as the gasket 130 so that they are substantially flush with each other so that they together form a smooth sealing surface. Thus, in a typical commercial embodiment in which the gasket 130 has a thickness of about ¼ inch, the gasket-spanning segment 146 has a conforming thickness T of about ¼ inch. In addition, to provide for good sealing performance, the rigid portion 140 of the fuel conduit 132, or at least its gasket-spanning segment 146, can be coated with a coating having good sealing properties such as rubber or a thermoplastic elastomer. In typical commercial embodiments, for example, the rigid portion 140 of the fuel conduit 132 has a coating of rubber of about 0.001 inch to about 0.01 inch, with the exact thickness selected so that the gasket-spanning segment 146 of the fuel conduit is flush with the gasket 130.

The width W of the gasket-spanning segment 146 of the fuel conduit 132 is selected so that, given the thickness T, a sufficient volume flow rate of alternative fuel 128 is delivered through the gasket-spanning segment. In a typical commercial embodiment, the gasket-spanning segment 146 has a width W of about ½ inch. The gasket-spanning segment 146 of the fuel conduit 132 extends through an opening 147 in the gasket 130 that extends transversely (e.g., radially) all the way through the gasket. Thus, the gasket 130 does not form a complete circle, but instead has a gap that serves as the fuel-conduit opening 147. The size and shape of the gasket's fuel-conduit opening 147 is selected for receiving through it the fuel conduit's gasket-spanning segment 146 with mating conformity to provide a good seal.

In addition, the fuel conduit 132 includes a bend 152 that divides the fuel conduit into first and second segments 154 and 156 that are angled with respect to each other. The bend 152 can be about a 90-degree turn (as depicted) or a smoother or sharper turn or curve. The first segment 154 includes the gasket-spanning segment 146 and is designed for passing the fuel 128 through the gasket 130 and into the carburetor 112. And the second segment 156 traverses along the carburetor 112 axial length in the venturi area and includes the outlet end 150. (In embodiments including the rigid and flexible segments 140 and 142, the first segment 154 includes the flexible segment and a portion of the rigid segment, and the second segment 156 includes the rest of the rigid segment.)

In the depicted embodiment, the bend 152, the length of the first segment 154 within the carburetor 112, and the length of the second segment 156 are selected so that the fuel conduit outlet end 150 is positioned immediately adjacent the outlet end 108 of the primary fuel inlet 106 of the carburetor 112 (see FIG. 2). The fuel conduit outlet end 150 is preferably positioned past the maximum constriction in the venturi area at the trailing side of the venturi area (with respect to the direction of airflow), which typically results in the outlet end being positioned within about ⅛ inch of the outlet end 108 of the primary fuel inlet 106. In this way, the alternative fuel 128 is introduced into the carburetor 112 in the venturi area at practically the same location as the primary fuel was introduced according to the original design of the carburetor. In a typical commercial embodiment, for example, the bend 152 is an about 90-degree angle, the length of the first segment 154 within the carburetor 112 is about ¼ inch, and the length of the second segment 156 is about 1 inch. Making the bend 152 a 90-degree angle allows the second segment 156 to be oriented parallel to the airflow axis of the carburetor and the general direction of the airflow, thereby minimizing any resistance or other disruption in the airflow through the carburetor as designed. For the bend 152 to be 90 degrees and the second segment 156 to be parallel, the length of the first segment 154 within the carburetor 112 is substantially the same as length of the primary fuel inlet tube within the carburetor. Thus, in a typical commercial embodiment in which the length of the first segment 154 within the carburetor 112 is about ¼ inch, this length is selected to conform to a ¼-inch length of the primary fuel inlet tube extending into the carburetor.

In alternative embodiments, the fuel conduit outlet end 150 is not positioned immediately adjacent the outlet end 108 of the primary fuel inlet 106 of the carburetor 112, but is still positioned within the venturi area of the carburetor 112. In some such embodiments, the angle of the bend 152, the length of the first segment 154 within the carburetor 112, and the length of the second segment 156 are selected so that the fuel conduit outlet end 150 is not positioned immediately adjacent the outlet end 108 of the primary fuel inlet 106 of the carburetor 112, but is positioned closer to it than the inlet end of the carburetor 112 (i.e., closer than that place where the fuel conduit 134 extends through the gasket 130 and into the carburetor). For example, the length of the first segment 154 within the carburetor 112 can be a little shorter than is needed to extend all the way to immediately adjacent the outlet end 108 of the primary fuel inlet 106 of the carburetor 112. In other such embodiments, the bend 152 is less than 90 degrees (e.g., 45 degrees), and positioned just radially inside the carburetor 112. In still other such embodiments, the fuel conduit 132 does not include the bend 152 and the second segment 156, instead the fuel conduit free outlet end 150 extends radially to just inside the gasket air opening 134 (and just inside the venturi area of the carburetor 112).

In this way, the inductor 110 functions both to provide a sealing gasket 130 between the carburetor 112 and the air filter 114 and to introduce the alternative fuel 128 into the carburetor. And it does so while adding a much smaller amount of overall size/length to the engine 116 than do conventional adapters. So there are no/fewer issues with insufficient space for the air filter 114, cutting the engine mounting frame, etc., and the installation is much easier and quicker than with conventional adapters. In addition, in some embodiments the inductor 110 introduces the alternative fuel 128 into the carburetor 112 immediately adjacent the outlet end of the primary fuel inlet of the carburetor, thereby maintaining the fuel efficiency of the engine as designed.

A method of manufacturing the inductor 110 includes flattening a portion of the rigid segment 140 of the fuel conduit 132 from the initial circular shape of the tubing used into its generally rectangular shape (thereby forming the transition 148), cutting it to length, forming the bend 152 (by bending the tubing or cutting two lengths and bonding them together for example by soldering), applying a coating (e.g., rubber), and connecting it to the flexible segment 142 of the fuel conduit 132. In some embodiments, the rigid segment 140 of the fuel conduit 132 can be provided as an all-in-one rubber/plastic piece that can be heated, bent, and formed or molded. The fuel-conduit opening 147 is punched, cut, or otherwise removed from a conventional gasket 130, and the fuel conduit 132 is placed flush into the fuel-conduit opening 147 and bonded (e.g., with epoxy of another adherent) or otherwise attached in place. In some embodiments, the gasket 130 is provided with the fuel-conduit opening 147 pre-formed in it. Also, the mounting holes 136 are formed in the gasket 130 to accommodate the stud pattern and size of the carburetor 112 (or the gasket can be selected with the appropriate mounting holes pre-formed in it). The mounting holes 136 can be placed strategically and/or formed as curved slots to allow the same inductor 110 to be used on any of several different brands and sizes of carburetors and engines.

A method of retrofitting the inductor 110 onto an existing engine to convert it from burning a primary fuel to burning an alternative fuel will now be described. First, the air filter 114 is removed from the carburetor 112, and the existing gasket between the two is removed and discarded. The sealing surfaces of the air filter 114 and the carburetor 112 are cleaned and prepared for re-sealing, for example by applying a layer of gasket sealer or using thin supplemental gaskets (e.g., paper gaskets). The inductor 110 to be installed is selected for the particular carburetor 112 and alternative fuel desired to be burned. The inductor 110 is then positioned on the carburetor 112, and the air filter 114 positioned onto the inductor, with the mounting holes 136 aligned, and the studs are screwed in to secure these parts in place. An alternative-fuel line, which is connected to an alternative-fuel tank, is then attached to the connector 144 at the inlet end of the fuel conduit 132. A control valve can be provided in the alternative-fuel line to selectively close off the alternative fuel supply. The primary-fuel inlet 106 of the carburetor 112 can be disconnected from the primary fuel line and tank, or a control valve can be installed in the primary fuel line to selectively close off the primary-fuel supply. The engine is now ready to be run on the alternative fuel, without permanently altering the primary-fuel capability of the carburetor 112, without making any alterations to the engine frame or the air-inlet hose or replacing or modifying the mounting studs, and without diminishing the performance and efficiency of the engine. In alternative conversion methods, the inductor 110 is adapted for mounting to the airflow outlet side of the carburetor.

Figure 5:
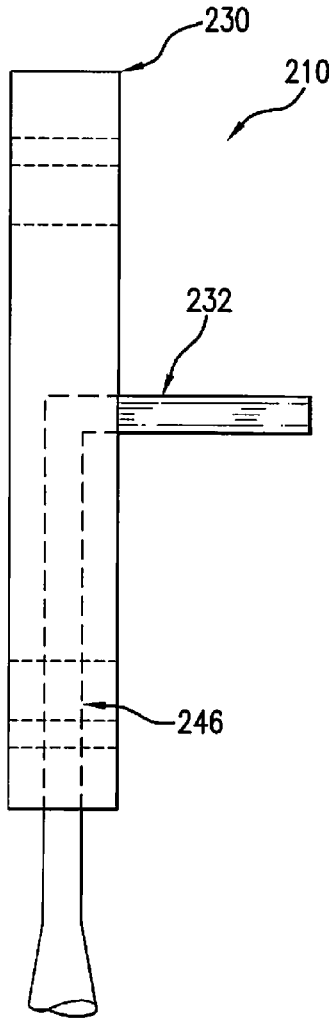
FIG. 5 is a side view of a portion of an alternative-fuel inductor according to a second example embodiment of the present invention, showing the gasket-spanning segment of the fuel conduit having a lesser thickness than the gasket.
Figure 6:
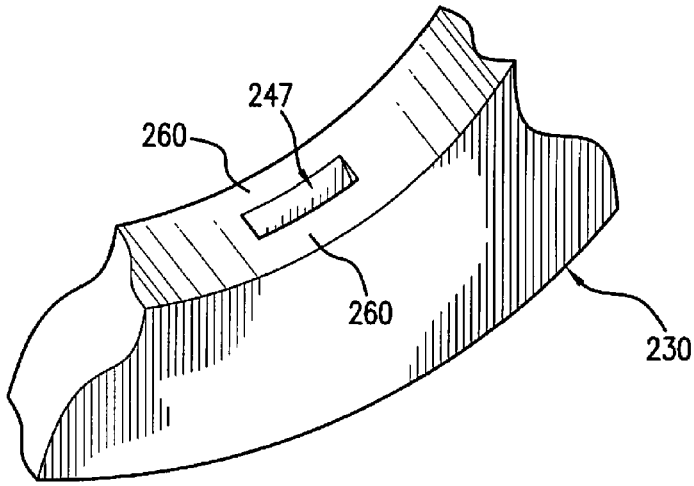
FIG. 6 is a perspective view of a portion of the inductor of FIG. 5, showing an opening in the gasket through which the fuel conduit extends.
Figure 7:
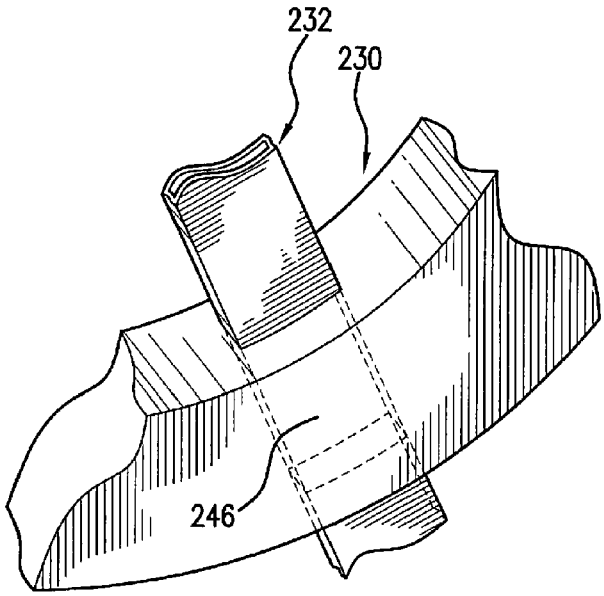
FIG. 7 shows the portion of the inductor of FIG. 5 with the fuel conduit extending through the fuel-conduit opening in the gasket.

FIGS. 5-7 show portions of an alternative-fuel inductor 210 according to a second example embodiment of the present invention. The alternative-fuel inductor 210 of this embodiment is similar to that of the first embodiment described above. In this embodiment, the fuel conduit 232 and gasket 230 are identical, except that the gasket is thicker than the gasket-spanning segment 246 of the fuel conduit 232. So while the fuel-conduit opening 247 extends radially all the way through the gasket 230, it does not extend all the way axially through it. Thus, the gasket 230 of the depicted embodiment includes side panels 260 on both sides of the fuel-conduit opening 247. In typical commercial embodiments, the side panels 260 are about 1/16-inch to about 1/8-inch thick each, thereby adding only about 1/8 inch to about 1/4 inch total to the thickness of the gasket 230. In this way, the gasket 230 is better able to seal the air filter and carburetor together, without adding significantly to the overall size/length. In addition, the material selected for the gasket 130 is typically more compressible in this embodiment than in the first embodiment. Finally, with the fuel-conduit opening 247 not extending axially all the way through the gasket 230, the width sides W of the generally rectangular gasket-spanning segment are sufficiently flat that the gasket-spanning segment 246 provides good sealing performance (they can have some slight curvature and still provide a good seal). In alternative embodiments, the fuel-conduit opening is formed as a lateral recess in the gasket, so the gasket has only one side panel.

Figure 8:
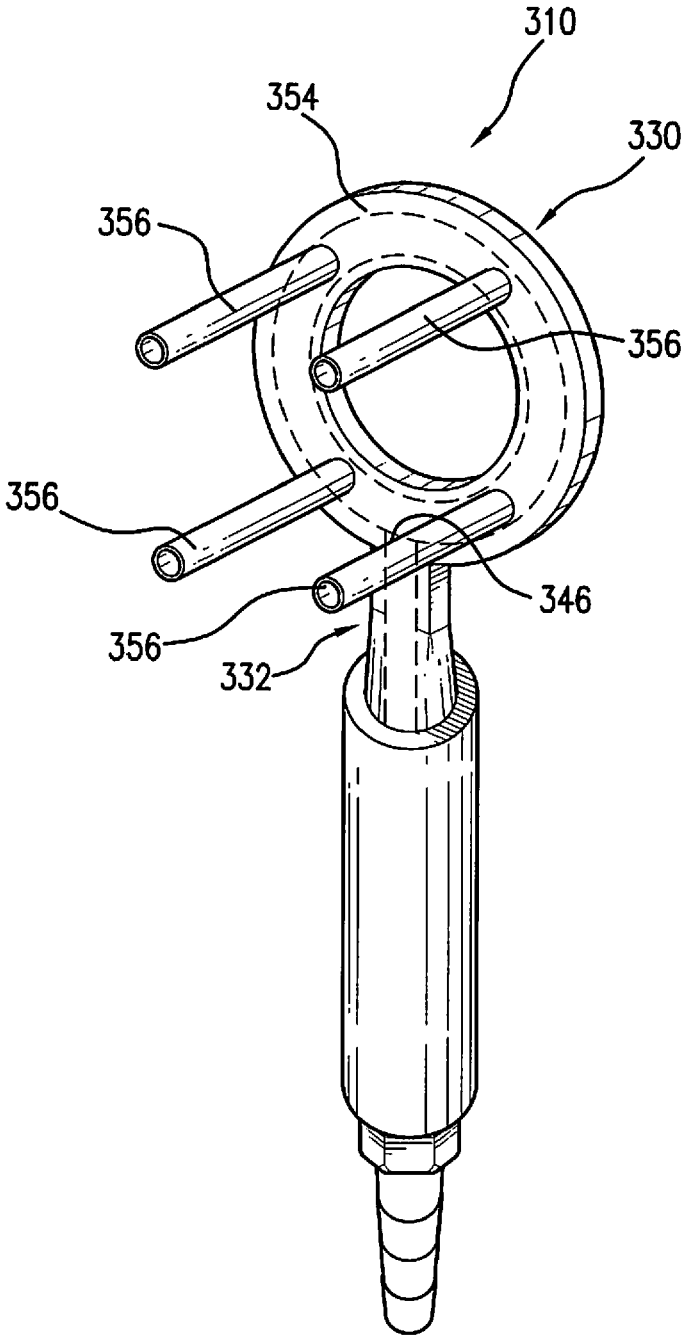
FIG. 8 is a perspective view of an alternative-fuel inductor according to a third example embodiment of the present invention.

FIG. 8 shows an alternative-fuel inductor 310 according to a third example embodiment of the present invention. The alternative-fuel inductor 310 of this embodiment is similar to that of the first embodiment described above. In this embodiment, the fuel conduit 332 and gasket 330 are identical, except that the first and second segments 354 and 356 of the fuel conduit are different. The first segment 354 includes the gasket-spanning segment 346 and is designed for passing the alternative fuel through the gasket 330 and into the carburetor. But in this embodiment, the first segment 354 is annular and extends around the periphery of the gasket (e.g., internally) to provide a path for delivering the alternative fuel around the periphery of the gasket. Also in this embodiment, there are a plurality of the second segments 356 that each traverse along the carburetor length through the venturi area and that each include an outlet end. The second segments 356 extend from the first segment 354 at bends (e.g., 90-degree angles). There can be four of the second segments 356, as depicted, or more or fewer of them can be provided, as may be desired. In alternative embodiments, the first segment 354 does not extend all the way around the periphery of the gasket (e.g., it can be semi-circular) and the second segments 356 are fed from only one or the other direction. With this multi-outlet design, the alternative fuel is initially more dispersed/distributed when it enters the carburetor so that the fuel and air are better mixed for combustion, thereby providing for a more complete combustion and higher fuel efficiency.

It should be noted that the inductor 310 does not have any mounting holes. In this embodiment, the inductor 310 is small enough in diameter that it "rides" inside the area between the mounting studs so that it can be repositioned to not interfere with fixed areas of the engine. This and other features of any of the embodiments described herein can be incorporated into any of the other embodiments described herein and into various combinations of embodiments not specifically described herein.

Figure 9:
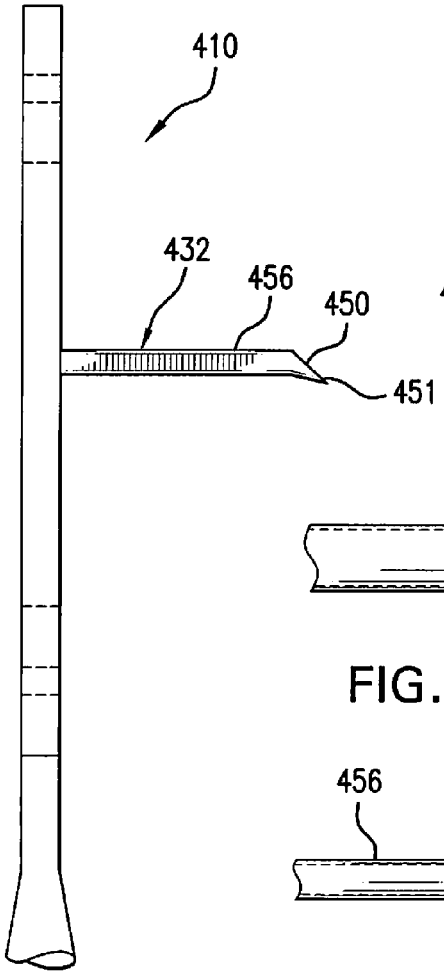
FIG. 9 is a side view of a portion of an alternative-fuel inductor according to a fourth example embodiment of the present invention, showing the fuel inlet conduit having a plurality of outlet ends.
Figure 10:
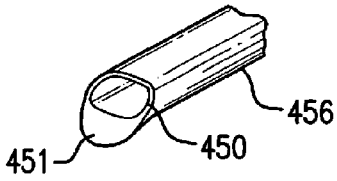
FIG. 10 is a perspective view of a portion of the inductor of FIG. 9.
Figure 11:
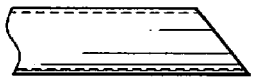
FIG. 11 is a side view of a length of circular tubing with its outlet end angled as a step of manufacturing the inductor portion of FIG. 10.
Figure 12:
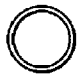
FIG. 12 is an end view of the circular tubing length of FIG. 11.
Figure 13:
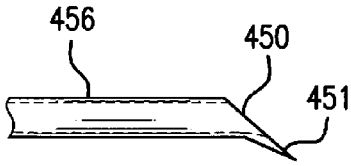
FIG. 13 is a side view of the inductor portion of FIG. 10, which has been formed by flattening the circular tubing length of FIG. 11 into a generally rectangular cross-section.
Figure 14:
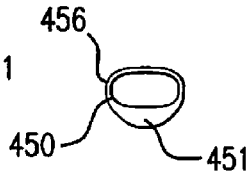
FIG. 14 is an end view of the inductor portion of FIG. 13.

FIGS. 9-14 show an alternative-fuel inductor 410 according to a fourth example embodiment of the present invention. The alternative-fuel inductor 410 of this embodiment is similar to that of the first embodiment described above. In this embodiment, however, the outlet end 450 of the second segment 456 of the fuel conduit 432 is angled. In one typical commercial embodiment, the outlet end 450 has a 45-degree angle. In other embodiments, the angle is greater than or less than 45 degrees. The angled outlet end 450 can be linearly angled (as depicted in FIGS. 9 and 13), angled by a curve, or a combination thereof. In addition, the angled outlet end 450 can be formed having a pointed tip 451 that extends radially beyond the outer periphery of the second segment 456. The pointed tip 451 can be formed at the same angle as the rest of the outlet end 450. Thus, the entire outlet end 450, including the pointed tip 451, can be at a 45-degree angle (as depicted in FIGS. 9 and 13).

Preferably, the position of the angled outlet end 450 is such that it faces toward the axial center of the carburetor. That is, the second segment 456 is longer on its outer side (closest to the inner wall of the carburetor where the primary fuel inlet is located) and shorter on its inner side (closest to axial center of the carburetor). The length of the second segment 450 can be selected so that the end of the pointed tip 451 is positioned past the maximum constriction in the venturi area at the trailing side of the venturi area (with respect to the direction of airflow), which typically results in the pointed tip being immediately adjacent the primary fuel inlet in the venturi area of the carburetor. Using this angled design and positioning it as described can significantly increase the negative pressure signal to the engine regulator, thereby significantly improving overall engine performance.

The inductor 410 can be manufactured by cutting a tube at the desired angle (e.g., 45 degrees) while still in the circular shape (see FIGS. 11-12). After that, the circular tube is flattened into the generally rectangular shape, and then the pointed tip 451 is bent back into alignment with the rest of the outlet end 450 so that the entire outlet end (including the pointed tip) is at the same angle (see FIGS. 13-14).

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. An inductor for a carburetor for burning an alternative fuel, the inductor comprising:

a gasket defining an axial airflow opening and a transverse fuel-conduit opening, wherein the gasket is adapted to form a seal with the carburetor; and a fuel conduit having an outlet end and extending transversely through the fuel-conduit opening and into the axial airflow opening, wherein when the inductor is mounted to the carburetor the outlet end of the fuel conduit is positioned in the carburetor.

2. The alternative-fuel inductor of claim 1, wherein the carburetor includes a venturi area and the fuel conduit has a length within the carburetor so that the outlet end is positioned within the venturi area.

3. The alternative-fuel inductor of claim 1, wherein the fuel-conduit opening includes a bend and first and second segments that are angled with respect to each other by the bend, wherein the first segment includes a gasket-spanning segment that extends through the fuel-conduit opening of the gasket, and the second segment extends within the carburetor and includes the outlet end.

4. The alternative-fuel inductor of claim 3, wherein the bend in the fuel conduit is at 90 degrees and the second segment of the fuel conduit is generally parallel to an airflow axis of the carburetor.

5. The alternative-fuel inductor of claim 3, wherein the carburetor includes a primary fuel inlet, and the second segment of the fuel conduit has a length so that the outlet end is positioned immediately adjacent the primary fuel inlet.

6. The alternative-fuel inductor of claim 3, wherein the carburetor includes a primary fuel inlet with a length inside the carburetor, and the first segment of the fuel conduit has a portion inside the carburetor with a length that is substantially the same as the length of the primary fuel inlet inside the carburetor.

7. The alternative-fuel inductor of claim 1, wherein the fuel conduit outlet end is angled.

8. The alternative-fuel inductor of claim 7, wherein the fuel conduit outlet end is angled at 45 degrees.

9. The alternative-fuel inductor of claim 7, wherein the fuel conduit outlet end has a pointed tip.

10. The alternative-fuel inductor of claim 1, wherein the fuel-conduit opening extends axially all the way through the gasket, and the gasket and a gasket-spanning segment of the fuel conduit have substantially the same thickness so that they are axially flush with each other to cooperate in forming a good seal against the carburetor.

11. The alternative-fuel inductor of claim 1, wherein the fuel-conduit opening extends axially only partially through the gasket, and the gasket has at least one side panel adjacent the fuel-conduit opening.

12. The alternative-fuel inductor of claim 3, wherein the fuel-conduit opening and the fuel conduit first segment extend at least a portion of the way around a periphery of the gasket, and the fuel conduit second segment is provided by a plurality of second segments extending from the first segment.

13. The alternative-fuel inductor of claim 12, wherein the fuel conduit first segment extends all the way around the periphery of the gasket.

14. The alternative-fuel inductor of claim 1, wherein the gasket is about ½-inch thick or less.

15. The alternative-fuel inductor of claim 1, wherein the portion of the fuel conduit inside the carburetor has an outer surface with a coating.

16. The alternative-fuel inductor of claim 1, wherein the fuel conduit includes a gasket-spanning segment that extends through the fuel-conduit opening of the gasket, and at least the gasket-spanning segment of the fuel conduit is made of a rigid material.

17. An inductor for a carburetor for burning an alternative fuel, the carburetor including a venturi area and defining an axial airflow opening, the inductor comprising:

a gasket defining an axial airflow opening and a radial fuel-conduit opening, wherein the gasket airflow opening and the carburetor axial airflow opening have the same size and shape, the fuel-conduit opening of the gasket has a generally rectangular shape, and the gasket is adapted to form a seal with the carburetor; and a fuel conduit including a bend and first and second segments that are angled with respect to each other by the bend, wherein the first segment includes a generally rectangular gasket-spanning segment that extends radially through the fuel-conduit opening of the gasket and into the axial airflow opening, the gasket-spanning segment of the fuel conduit is sized and shaped so that it is received in the gasket fuel-conduit opening forming a good seal, and the second segment extends axially within the carburetor, includes an outlet end, and has a length within the carburetor so that, when the inductor is mounted to the carburetor, the outlet end of the fuel conduit is positioned within the venturi area of the carburetor.

18. The alternative-fuel inductor of claim 17, wherein the bend in the fuel conduit is at 90 degrees and the second segment of the fuel conduit is generally parallel to an airflow axis of the carburetor.

19. The alternative-fuel inductor of claim 17, wherein the carburetor includes a primary fuel inlet with a length inside the carburetor, the first segment of the fuel conduit has a portion inside the carburetor with a length that is substantially the same as the length of the primary fuel inlet inside the carburetor, and the second segment of the fuel conduit has a length so that the outlet end is positioned immediately adjacent the primary fuel inlet.

* * * * *